US010344356B2

(12) United States Patent
Yang et al.

(10) Patent No.: US 10,344,356 B2
(45) Date of Patent: Jul. 9, 2019

(54) ALLOY MATERIAL WITH HIGH STRENGTH AND TOUGHNESS AND ITS FABRICATION METHOD OF SEMI-SOLID SINTERING

(71) Applicant: SOUTH CHINA UNIVERSITY OF TECHNOLOGY, Guangzhou (CN)

(72) Inventors: Chao Yang, Guangzhou (CN); Yaguang Yao, Guangzhou (CN); Limei Kang, Guangzhou (CN); Lehua Liu, Guangzhou (CN); Shengguan Qu, Guangzhou (CN); Weiping Chen, Guangzhou (CN); Yuanyuan Li, Guangzhou (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 248 days.

(21) Appl. No.: 15/322,183

(22) PCT Filed: Dec. 29, 2015

(86) PCT No.: PCT/CN2015/099634

§ 371 (c)(1),
(2) Date: Dec. 27, 2016

(87) PCT Pub. No.: WO2016/127716

PCT Pub. Date: Aug. 18, 2016

(65) Prior Publication Data

US 2017/0137917 A1 May 18, 2017

(30) Foreign Application Priority Data

Feb. 13, 2015 (CN) ..... 2015 1 0082667

(51) Int. Cl.
*C22C 1/04* (2006.01)
*C22C 14/00* (2006.01)
(Continued)

(52) U.S. Cl.
CPC ..... *C22C 1/0458* (2013.01); *B22F 3/14* (2013.01); *B22F 3/16* (2013.01); *B22F 3/17* (2013.01);
(Continued)

(58) Field of Classification Search
CPC ..... C22C 1/04; C22C 1/0458; C22C 14/00; C22C 33/02; B22F 3/14; B22F 3/16;
(Continued)

(56) References Cited

U.S. PATENT DOCUMENTS 5,368,812 A * 11/1994 Calka ..... C04B 35/56 264/86
5,466,310 A * 11/1995 Ninham ..... C04B 35/58007 148/513
5,842,108 A 11/1998 Kim et al.

FOREIGN PATENT DOCUMENTS

CN 101381104 3/2009
CN 101492781 8/2010
(Continued)

OTHER PUBLICATIONS

Chen et al, "Ultrafine-grained Ti-based composites reinforced by TiC/TiB2 particles fabricated by spark plasma sintering", Sintia Sinica Phys, Mech, and Astron 41:1277-1286, 2011 (abstract only ranslated).

*Primary Examiner* — Cam N. Nguyen
(74) *Attorney, Agent, or Firm* — JMB Davis Ben-David

(57) ABSTRACT

The present invention belongs to the technical field of the preparation of alloy materials, and discloses a high strength and toughness alloy material, a method for preparing the alloy material by semi-solid sintering, and application thereof. The preparation method comprises the three steps of mixing powders, preparing alloy powders by high-energy ball milling, and semi-solid sintering of alloy powders, the key point lies in the two-step sintering, wherein the tem-
(Continued)

perature is heated to less than the initial melting temperature of the lowest-temperature melting peak of the alloy powder, under the sintering pressure conditions, and carried out a sintering densification treatment; after pressure release, the temperature is heated to the sintering temperature Ts, and maintained at the same temperature, and a semi-solid processing is carried out, with a sintering temperature Ts: Ts≥the initial melting temperature of the lowest-temperature melting peak of the alloy powder, Ts≤the initial melting temperature of the highest-temperature melting peak of the alloy powder. By using the present method, a variety of high melting point alloy systems comprising such as Ti-based, Ni-based alloy system, and the like are carried out a semi-solid processing, so as to obtain an alloy material with a novel microstructure such as nanocrystalline, ultra-fine crystalline, fine crystalline or bimodal structure, and the like, and having excellent performances, which can be widely used in the fields of aerospace, military, instruments and the like.

9 Claims, 2 Drawing Sheets

(51) Int. Cl.

| | |
|---|---|
| ***C22C 33/02*** | (2006.01) |
| ***B22F 3/14*** | (2006.01) |
| ***B22F 3/16*** | (2006.01) |
| ***B22F 3/17*** | (2006.01) |
| ***B22F 3/18*** | (2006.01) |
| ***B22F 3/20*** | (2006.01) |
| ***B22F 3/24*** | (2006.01) |
| ***B22F 9/04*** | (2006.01) |
| *B22F 3/105* | (2006.01) |

(52) U.S. Cl.
CPC ..... *B22F 3/18* (2013.01); *B22F 3/20* (2013.01); *B22F 3/24* (2013.01); *B22F 9/04* (2013.01); *C22C 1/04* (2013.01); *C22C 14/00* (2013.01); *C22C 33/02* (2013.01); *B22F 2003/1051* (2013.01); *B22F 2003/175* (2013.01); *B22F 2003/185* (2013.01); *B22F 2003/208* (2013.01); *B22F 2003/248* (2013.01); *B22F 2009/043* (2013.01); *B22F 2301/205* (2013.01); *B22F 2998/10* (2013.01); *B22F 2999/00* (2013.01)

(58) Field of Classification Search
CPC ..... B22F 3/17; B22F 3/18; B22F 3/20; B22F 3/24; B22F 9/04
See application file for complete search history.

(56) References Cited

FOREIGN PATENT DOCUMENTS

| | | |
|---|---|---|
| CN | 102534301 | 7/2012 |
| CN | 101211077 | 9/2012 |
| CN | 103122426 | 7/2014 |
| CN | 104674038 | 6/2015 |
| KR | 20130125649 | 11/2013 |

* cited by examiner

ALLOY MATERIAL WITH HIGH STRENGTH AND TOUGHNESS AND ITS FABRICATION METHOD OF SEMI-SOLID SINTERING

CROSS REFERENCE TO RELATED APPLICATIONS

This is the U.S. National Stage of International Application No. PCT/CN2015/099634 filed on Dec. 29, 2015, which was published in Chinese under PCT Article 21(2), which in turn claims the benefit of Chinese Patent Application No. 201510082667.5 filed on Feb. 13, 2015.

TECHNICAL FIELD

The present invention belongs to the technical field of the fabrication of alloy materials, particularly to a high strength and toughness alloy material and its fabrication method of semi-solid sintering and application thereof.

BACKGROUND ART

Semi-solid metal processing refers to a metal forming processing method which is achieved by using the semi-solid temperature regions during the metal transition from solid state to liquid state, or from liquid state to solid state. In early 1970s, the semi-solid processing technology was firstly proposed by those researchers in Massachusetts Institute of Technology, USA. This technology employs two typical characterizations of non-dendritic and semi-solid slurry, breaks the traditional dendrite solidification mode, and has the unique advantages such as small deformation resistance, high material utilization rate, easy to implement automation, prone to form novel processing technology, etc., thus attracting highly attentions from the researchers in various countries, and the products prepared by semi-solid processing and application thereof are also developed rapidly.

However, so far, the studies of the semi-solid processing technology are mainly focused on the low melting point alloy system, such as aluminum alloy, magnesium alloy and the like, and the microstructure of the prepared alloy has relatively large and coarse grains. At the same time, the microstructures of fine grains such as ultra-fine crystalline, nanocrystalline, etc., can not be obtained by using the conventional semi-solid processing methods (such as rheocasting, rheoforging, thixoforging, etc.), let alone prepare the bimodal microstructure wherein any two size grains selected from the three structures of fine crystalline, ultra-fine crystalline, and nanocrystalline. In fact, the research results show that the presence of the bimodal microstructure in iron, titanium, aluminum and alloy thereof will generally significantly improve the comprehensive performances of the bulk material. In addition, the preparation of the slurry and billet material in the conventional semi-solid processing method is complicated, and it is hard to prepare the semi-solid slurry of the high melting point alloy, thus limiting the research and application of the semi-solid processing in the high melting point alloy system such as titanium alloy, nickel alloy, and the like.

In recent years, a series of the titanium alloy materials with a bimodal structure of nanocrystalline matrix/amorphous matrix+micron-sized ductile β-Ti dendrite have been obtained by the research stuffs using the copper mold casting rapid solidification method. During the deformation, the nanocrystalline matrix/amorphous matrix contributes to the ultra high strength, and the ductile β-Ti dendrite contributes to the high plasticity of the material, with a fracture strength of more than 2000 MPa, and a fracture strain of more than 10%. Thereafter, more and more the high strength and toughness alloy systems having such microstructure (comprising Fe-based, Zr-based, Ti-based, etc.) are reported. The key point of the preparation method lies in that the alloy components are elaborately designed and the solidification conditions of the alloy melt are precisely controlled [G. He, J. Eckert, W. Loser, and L. Schultz, *Nat. Mater.* 2, 33 (2003)], wherein during the solidification process, the suitable temperature maintaining regions are selected so that the β-Ti phase is preferentially nucleated and grown, and formed dendrites, then the remaining alloy melt is rapidly cooled to form nanocrystalline or amorphous matrix. However, there are two disadvantages present in this method, one is that as the five-components composition is prone to form intermetallic compounds, the enhancement effect of the dendrite is counteracted, the ductility of the material is deteriorated, so that the ranges of the components which can form the nanocrystalline matrix/amorphous matrix+ductile β-Ti dendrite are relatively narrow; the other one is that during the copper mold casting process, the cooling rate is limited, so that the prepared high strength and toughness titanium alloy with the bimodal structure has a size of several millimeters (less than 4 mm) in general. The above-mentioned factors become a bottleneck for practical application of these high strength and toughness titanium alloys with the bimodal structure.

As an alternative forming technology, powder metallurgy technology has the characteristics for examples, the prepared material has uniform composition, the material utilization rate is high, such technology is a near-net-shape forming technology, and the like, and it is easy to prepare a high strength and toughness alloy with a ultra-fine crystalline/nanocrystalline structure, which is commonly used to prepare a relatively large size and complicated shape alloy parts. As for the combination of the semi-solid processing technology and the powder metallurgy technology (such as powder forging, powder extrusion, powder rolling, etc.), generally, the low melting point matrix alloy particles and the high melting point reinforcing particles are mixed, then heated to the semi-solid region of the matrix alloy, stirred, and further processed and formed to prepare a composite material. However, as the inherent defects are present in the additional reinforcing phase in the composite material (i.e, the poor wettability with the matrix alloy), and it is hard for the semi-solid powder metallurgy method to ensure the homogenous distribution of the second phase in the matrix, there are a substantial room for improvement in the performances of the composite material prepared by combining the semi-solid processing and the powder metallurgy technology.

In view of this, if a novel microstructure such as nanocrystalline, ultra-fine crystalline, fine crystalline or even bimodal structure can be obtained by using semi-solid processing technology in the high melting point alloy system such as titanium alloy and the like, it will provide a novel preparation method for developing a novel high performance and high melting point alloy material, and the engineering parts therefrom for industrial application.

SUMMARY

In order to overcome the aforementioned disadvantages and deficiencies in the prior art, the primary object of the present invention is to provide a method for preparing a high strength and toughness alloy material by semi-solid sintering. By using this method, a high strength and toughness and high melting point alloy with relatively large size, complicated shape, and microstructure of nanocrystalline, ultra-fine crystalline, fine crystalline, or dual-scale structure can be prepared and formed, as well as parts therefrom, thus overcoming the problems such as it is hard to prepare semi-solid slurry by the conventional semi-solid processing technology, it is hard to obtain the microstructure of nanocrystalline, ultra-fine crystalline, fine crystalline, or dual-scale structure, it is hard to obtain relatively large size bulk material by the rapid solidification method, and the like.

Another object of the present invention is to provide a high strength and toughness alloy material prepared by the abovementioned method.

A further object of the present invention is to provide use of the abovementioned high strength and toughness alloy material in the fields of aerospace, military, and instruments.

The objects of the present invention are achieved by the following schemes:

A method for preparing a high strength and toughness alloy material by semi-solid sintering, the method is a forming and preparation process by combining the powder metallurgy technology and the semi-solid processing technology, in particular comprising the steps and process conditions as follows:

Step 1: Mixing Powders

The elementary substance powders are placed in a powder mixing machine in proportion according to the designed alloy composition, and mixed to uniform.

Step 2: Preparing Alloy Powders by High-Energy Ball Milling

The homogenously mixed powders are placed into a ball mill to carry out high-energy ball milling, until forming alloy powders with nanocrystalline or amorphous structure.

Step 3: Semi-Solid Sintering of Alloy Powders

The alloy powders loaded in the sintering mould are consolidated by the powder metallurgy technology, the sintering temperature Ts is selected, and the sintering is carried out by two-step process, wherein the temperature is heated to less than the initial melting temperature of the lowest-temperature melting peak of the alloy powder under the sintering pressure conditions, and the alloy powders are carried out the sintering densification treatment; after pressure release, the temperature is increased to the sintering temperature Ts, and maintained at the same temperature, and the semi-solid processing is carried out, with the process conditions as follows:

the sintering temperature Ts: Ts≥the initial melting temperature of the lowest-temperature melting peak of the alloy powder Ts≤the initial melting temperature of the highest-temperature melting peak of the alloy powders the sintering pressure of 20~500 MPa;

cooling, so as to obtain a high strength and toughness alloy material.

Preferably, when the sintering mould used is a graphite mould, the sintering pressure in step 3 is preferably 30~50 MPa; and when the sintering mould used is tungsten carbide mould, the sintering pressure in step 3 is preferably 50~500 MPa.

The initial melting temperature of the lowest-temperature melting peak of the alloy powder and the initial melting temperature of the highest-temperature melting peak of the alloy powder in the present method are obtained by an analysis of thermophysical properties on the ball-milled alloy powders in the step 2. In the analysis of thermophysical properties, two or more melting peaks, and the initial melting temperature, peak melting temperature, and end melting temperature of each melting peak can be obtained.

The powder metallurgy technology in step 3 refers to any powder metallurgy technology commonly used in the art, i.e., any one of the methods such as powder extrusion, powder hot pressing, powder rolling, powder forging, spark plasma sintering, and the like.

The elementary substance powders in step 1 are the ones commonly used in preparing alloy in the art, which can be the powders prepared by various methods such as atomization process, electrolysis process, hydrogenation-dehydrogenation process, and the like, there are no specific limitations on the particle size, both fine powder and the relatively large particle size powder are available. The designed alloy composition refers to the target alloy composition.

There are no specific limitations on the high-energy ball milling conditions in step 2, as long as the effects of alloy powders having nanocrystalline or amorphous structure formed by ball milling can be obtained. The ball milling is carried out under an inert gas atmosphere, preferably under argon protection.

The temperature maintaining time in step 3 can be adjusted as necessary, preferably 2~10 min.

The high strength and toughness alloy material prepared in step 3 can also be carried out a post-heat treatment, for example, the prepared high strength and toughness alloy material is placed in a vacuum furnace to carry out the treatments such as annealing, and the like, so as to eliminate the residual stress and microstructure defects.

The high strength and toughness alloy material prepared by the abovementioned methods, can be of various alloy systems respectively according to the designs, comprising Ti-based, Ni-based, Zr-based, Cu-based, Co-based, Nb-based, Fe-based, Mn-based, Mo-based, Ta-based alloy system, and the like, particularly the high melting point alloy system, such as Ti-based, Ni-based alloy system, and the like. And the high strength and toughness alloy material prepared in the present invention has novel structure, comprising nanocrystalline, ultra-fine crystalline, fine crystalline or bimodal structure, so that it has excellent performances, and can be widely used in the fields of aerospace, military, instruments and the like.

The principles of the present invention are as follows:

The preparation method of present invention is directed to semi-solid processing a variety of alloy systems, particularly the high melting point alloy systems such as Ti-based, Ni-based alloy system and the like, thus obtaining an alloy material with excellent performances, having a novel microstructure such as nanocrystalline, ultrafine crystalline, fine crystalline or bimodal structure, etc. The method of the present invention is a forming and preparation method by combining the powder metallurgical technology and the semi-solid processing technology, and the key point lies in that the sintering temperature regions of the two-step sintering method are selected by measuring the melting peak of the alloy powder, so that the alloy powders are carried out sintering densification, then semi-solid processing, wherein the sintering temperature is between the initial melting temperature of the lowest-temperature melting peak and the initial melting temperature of the highest-temperature melting peak, and the sintering pressure is between 30~500 MPa. The present invention overcomes the problems for example it is hard to pulp in the conventional semi-solid processing technology, it is hard to obtain a bimodal structure, and the like, so that it is suitable for preparing a relatively large size, complicated shape, and engineering applicable high strength and toughness alloy material and parts therefrom, and has wide universality and practicality, and has good promotion and application prospects in the fields of aerospace, military, instruments and the like.

As compared with the prior art, the present invention has the advantages and beneficial effects as follows:

(1) The preparation method of the present invention may be directed to semi-solid processing a variety of alloy systems, particularly the rarely studied high-melting-point alloy systems such as Ti-based, Ni-based alloy system, and the like, thus obtaining an alloy material with excellent performances, having a novel microstructure such as nanocrystalline, ultra-fine cystalline, fine crystalline or bimodal structure, and the like, which has important theoretical and engineering significances in expanding semi-solid processing field.

(2) The powder metallurgy technology used in the present method can comprise any one of the methods, such as powder extrusion, powder hot pressing, powder rolling, powder forging, spark plasma sintering, and the like, thus can be used to prepare relatively large size, complicated shape, engineering applicable high strength and toughness alloy and parts therefrom, and has wide universality and practicality.

(3) The high strength and toughness alloy material prepared in the present invention, wherein the microstructure comprises nanocrystalline, ultra-fine crystalline, fine crystalline or dual-scale structure, has more excellent performances.

(4) As compared to the conventional semi-solid processing method, the present invention solves the problem for example it is hard to pulp, which can be achieved directly by ball mill pulverization and powder sintering according to the designed alloy composition, thus greatly saving the processing cost of the raw materials.

(5) As compared with the copper mold casting method which can only prepare small size high strength and toughness alloy, the present invention can prepare relatively large size, complicated shape, engineering applicable high strength and toughness alloy and the parts therefrom.

(6) As compared to the composite material prepared by the prior powder metallurgical semi-solid processing technology, the various phases obtained in the present invention are precipitated in situ, and there are no poor wettability problems between the phases, so that the prepared alloy has more excellent performances.

DETAILED DESCRIPTION

The present invention is further described in details below in combination with the examples and drawings, but the embodiments of the present invention are not limited thereto.

Example 1: Preparation of a High Strength and Toughness Titanium Alloy with a Bimodal Structure The method for preparing bimodal titanium alloy by semi-solid sintering comprises the steps of:

Step 1: Mixing Powders $Ti_{62}Nb_{12.2}Fe_{13.6}Co_{6.4}Al_{5.8}$ alloy system is selected, the powders are formulated according to the mass ratio of the selected alloy system, the elementary substance powders with an average particle size of 75 μm prepared with atomization process are selected in the present example, but the powder raw materials of the present invention are not limited thereto, the elementary powders may also be the powders prepared by other processes such as electrolysis process, and the like, and there are no specific limitations on the particle size, both fine powder and relatively large particle size powder are available. The abovementioned elementary powders are mixed to uniform in a powder mixing machine. The preferred alloy system in the present example is Ti-based alloy system, but the alloy systems selected in the present invention are not limited thereto, and Ni-based, Zr-based, Cu-based, Co-based, Nb-based, Fe-based, Mn-based, Mo-based, Ta-based alloy system, and the like can also be selected.

Step 2: Preparation of Alloy Powders by High-Energy Ball Milling

Figure 1:
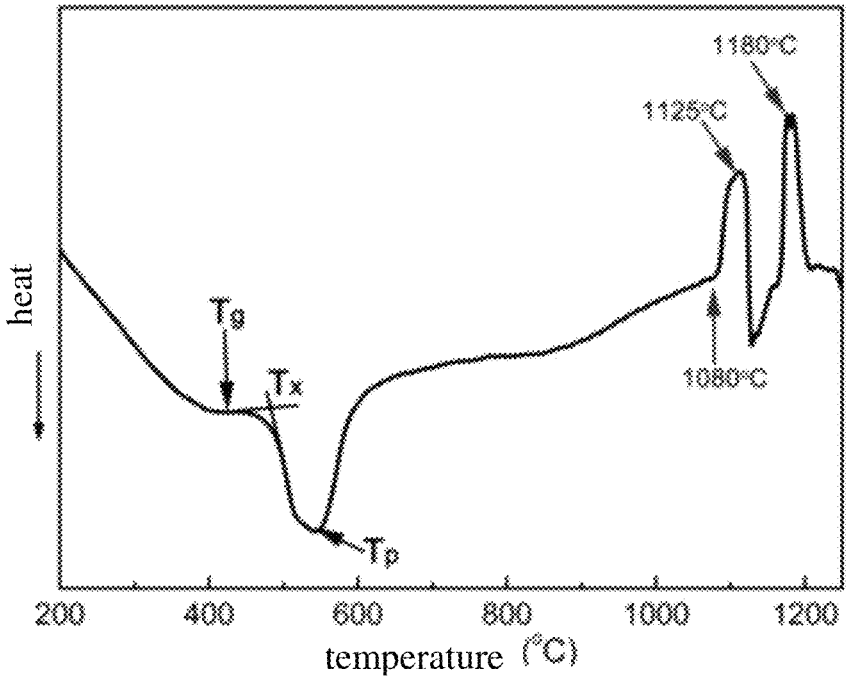
FIG. 1 is a differential scanning calorimetry curve of the high-energy ball milled alloy powders prepared in example 1.

The homogenously mixed powders are placed in a planetary ball mill (QM-2SP20) under argon protection to carry out high-energy ball milling, wherein the barrel body and ball milling medium, such as the grinding ball material, etc., are all made of stainless steel, the grinding balls have diameters of 15, 10, and 6 mm respectively, with a weight ratio of 1:3:1. The high energy ball milling has process parameters as follows: ball-milling barrel is filled with high purity argon (99.999%, 0.5 MPa) for protection; ratio of ball to powder is 8:1, rotating speed is 2 $s^{-1}$, about 3 g powders are taken every 10 h in a glove box under argon atmosphere to carry out the tests, such as X-ray diffraction (XRD), differential scanning calorimetry (DSC) analysis and the like, until after the ball milling time is 70 hours, the XRD detection shows that the structure of the powders which are ball milled for 70 h is about 90% by volume of β-Ti nanocrystalline surrounded by amorphous phase, the DSC curve in FIG. 1 shows that the powders which are ball-milled for 70 hours have two melting peaks with endothermic peak temperatures of 1125□ and 1180□ respectively, in the heating process.

Step 3: Semi-Solid Sintering of Alloy Powders 20 g alloy powders prepared in step 2 are taken and put into a graphite sintering mould with a diameter of 120 mm, the alloy powders are pre-pressed to 50 MPa via positive and negative graphite electrodes, and vacuumized to $10^{-2}$ Pa, then filled with high-purity argon gas for protection; and the rapid sintering is carried out by pulse current, with the process conditions as follows:

the sintering device: Dr. Sintering SPS-825 spark plasma sintering system sintering mode: pulse current a duty ratio of the pulse current: 12:2 a sintering temperature Ts: 1100° C.

a sintering pressure: 50 MPa a sintering time: the temperature is heated to 1050° C. under 50 MPa pressure in 10 minutes, the temperature is heated to 1100° C. under the pressure release condition in 1 minutes and maintained at the same temperature for 5 minutes.

Figure 2:
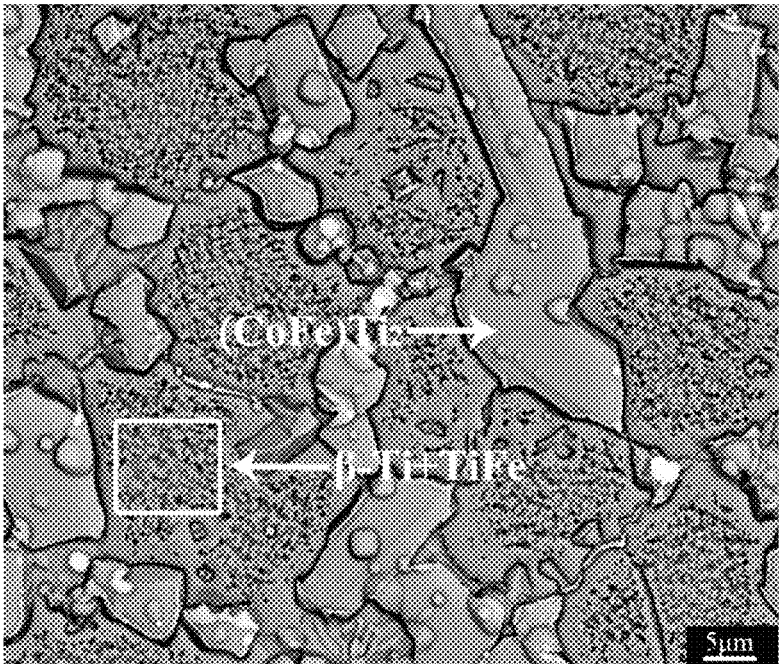
FIG. 2 is a scanning electron microscope image of a high strength and toughness titanium alloy with a bimodal structure prepared in example 1.
Figure 3:
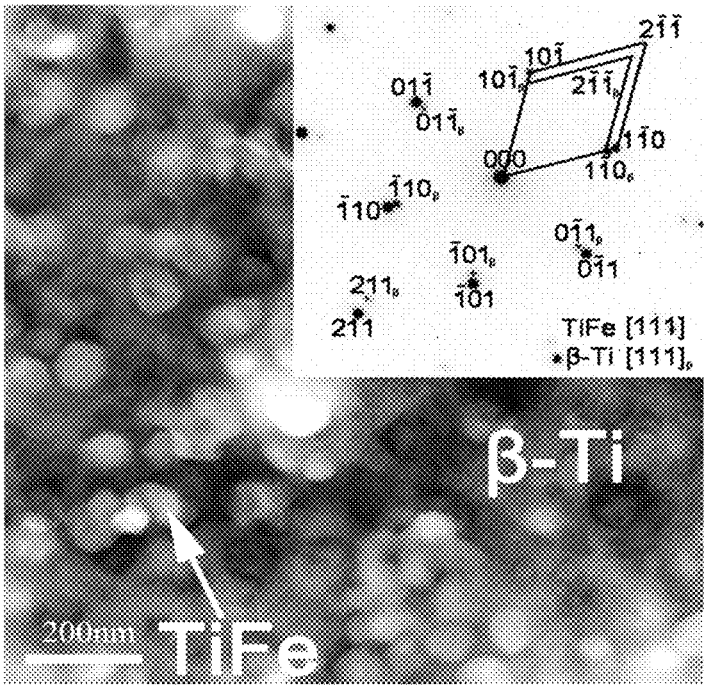
FIG. 3 is a transmission electron microscopy image of a high strength and toughness titanium alloy with a bimodal structure prepared in example 1.
Figure 4:
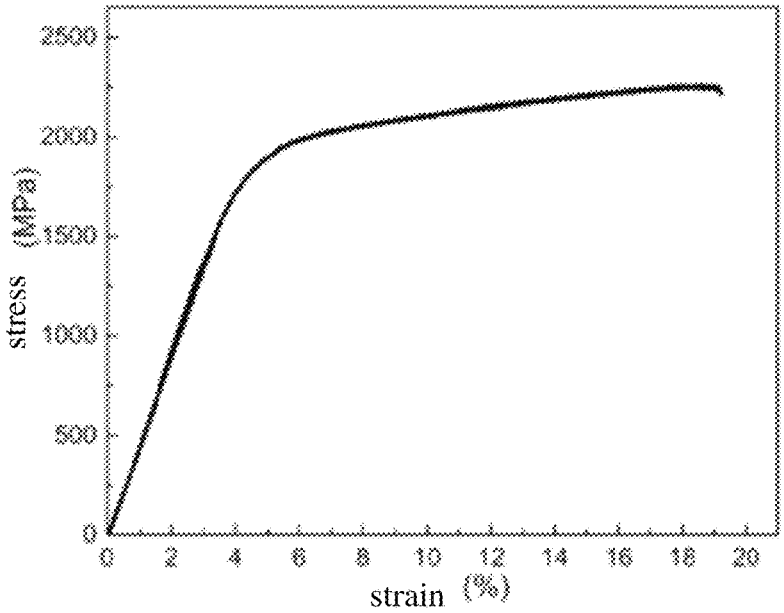
FIG. 4 is a stress-strain curve of a high strength and toughness titanium alloy with a bimodal structure prepared in example 1.

After sintering, a high strength and toughness titanium alloy material with a bimodal structure having a diameter of Φ20 mm (if the mould size is larger, the size of the prepared alloy material is also larger), and a density of 5.6 g/cm$^3$ is obtained. The scanning electron microscope image in FIG. 2, shows that the microstructure comprises the micron-sized (CoFe)$Ti_2$ phase region and the micron-sized mixed matrix. The transmission electron microscope image in FIG. 3 shows that the micron-sized mixed matrix is consisted of nano-sized TiFe surrounded by nano-sized β-Ti, therefore, the alloy has a bimodal structure of micron crystalline (CoFe)$Ti_2$ and nanocrystalline β-Ti and TiFe; the stress-strain curve in FIG. 4 shows that the compressive yield strength and fracture strain of the titanium alloy material with the bimodal structure are 1790 MPa and 19% respectively.

The abovementioned examples are the preferred embodiments of the present invention, but the embodiments of the present invention are not limited thereto, any other changes, modifications, alternatives, combination, simplification, which are all the equivalent replacement modes, made without departing from the spirit and principles of the invention, should be embraced within the scope of the present invention.

The invention claimed is:

1. A method for preparing a high strength and toughness alloy material by semi-solid sintering, comprising the steps and process conditions as follows:

step 1:

placing elementary substance powders proportionally into a powder mixing machine, and mixed so as to obtain homogeneously mixed powders;

step 2:

placing the homogeneously mixed powders into a ball mill to carry out high-energy ball milling, until forming alloy powders having nanocrystalline or amorphous structure;

step 3:

sintering the alloy powders loaded in a sintering mould consolidated by a powder metallurgy technology, selecting the sintering temperature Ts, and carrying out the sintering in a two-step process, wherein the temperature is heated to less than the initial melting temperature of the lowest-temperature melting peak of the alloy powder under sintering pressure conditions, and sintering densification of the alloy powders;

following pressure release, the temperature is heated to the sintering temperature Ts, maintaining the same temperature, and a semi-solid processing is carried out, with process conditions as follows:

the sintering temperature Ts:

Ts≥the initial melting temperature of the lowest-temperature melting peak of the alloy powder, Ts≤the initial melting temperature of the highest-temperature melting peak of the alloy powder;

the sintering pressure of 20-500 MPa; and step 4:

cooling to obtain a high strength and toughness alloy material.

2. The method for preparing a high strength and toughness alloy material by semi-solid sintering according to claim 1, when the sintering mould used is a graphite mould, the sintering pressure in step 3 is 30-50 MPa; and when the sintering mould used is a tungsten carbide mould, the sintering pressure in step 3 is 50-500 MPa.

3. The method for preparing a high strength and toughness alloy material by semi-solid sintering according to claim 1, wherein the powder metallurgy technology in step 3 is any one of powder extrusion, powder hot pressing, powder rolling, powder forging and spark plasma sintering.

4. The method for preparing a high strength and toughness alloy material by semi-solid sintering according to claim 1, wherein the elementary substance powders in step 1 are the powders prepared by atomization process, electrolysis process or hydrogenation-dehydrogenation process.

5. The method for preparing a high strength and toughness alloy material by semi-solid sintering according to claim 1, wherein the high strength and toughness alloy material prepared in step 3 is carried out a post-heat treatment.

6. The method for preparing a high strength and toughness alloy material by semi-solid sintering according to claim 1, wherein the high strength and toughness alloy material prepared in step 3 is carried out an annealing treatment.

7. The high strength and toughness alloy material, produced by the method according to any one of claims 1-6.

8. The high strength and toughness alloy material according to claim 7, wherein the high strength and toughness alloy material is Ti-based, Ni-based, Zr-based, Cu-based, Co-based, Nb-based, Fe-based, Mn-based, Mo-based or Ta-based alloy system.

9. The high strength and toughness alloy material according to claim 7, wherein the structure of the high strength and toughness alloy material comprises nanocrystalline, ultra-fine crystalline, fine crystalline or dual-scale structure.

* * * * *